United States Patent [19]

Brown

[11] Patent Number: 4,568,303

[45] Date of Patent: Feb. 4, 1986

[54] TOY FOR ELECTRONICALLY PLAYING RHYTHMICAL MELODY UPON ROTATION OR REVOLUTION THEREOF

[76] Inventor: Paul L. Brown, 982 Lakeview Way, Redwood City, Calif. 94062

[21] Appl. No.: 604,850

[22] Filed: Apr. 27, 1984

[51] Int. Cl.[4] ..... A63H 1/24; A63H 1/06; A63H 1/28

[52] U.S. Cl. ..... 446/242; 446/247; 446/258

[58] Field of Search ..... 446/233, 242, 245, 251, 446/252, 256, 258, 264, 265, 397, 484, 47; 200/80 R, 80 A, 80 B, 11.45 R, 61.46, 61.48

[56] References Cited

U.S. PATENT DOCUMENTS

| | | | |
|---|---|---|---|
| 229,218 | 6/1880 | Wier | 446/256 X |
| 271,428 | 1/1883 | Dannhorn | 446/256 X |
| 430,521 | 6/1890 | Gee | 446/258 |
| 748,087 | 12/1903 | Mighels et al. | 446/258 |
| 1,908,430 | 5/1933 | Lapsley | 200/61.48 |
| 2,611,995 | 9/1952 | Krapp | 446/242 |
| 2,662,945 | 12/1953 | Cockram | 200/61.48 |
| 2,739,419 | 3/1956 | Cleveland | 446/242 |
| 2,938,973 | 5/1960 | Swanwick | 200/61.48 |
| 3,153,968 | 10/1964 | Fuchs | 446/258 X |
| 3,162,979 | 12/1964 | Garoogian | 446/242 |
| 3,191,344 | 6/1965 | Yagjian | 446/242 |
| 3,199,248 | 8/1965 | Suzuki | 446/299 |
| 3,213,409 | 10/1965 | Bailey et al. | 200/61.45 R |
| 3,325,940 | 6/1967 | Davis | 446/242 |
| 3,583,092 | 6/1971 | Schoenfield | 446/258 X |
| 3,645,037 | 2/1972 | Baginiski et al. | 446/258 X |
| 3,745,697 | 7/1973 | Wang | 446/242 |
| 3,755,960 | 9/1973 | Tepper et al. | 446/299 |
| 3,798,834 | 3/1974 | Samuel | 446/47 |
| 3,935,669 | 2/1976 | Potrzuski et al. | 446/242 X |
| 4,080,753 | 3/1978 | Hiner et al. | 446/47 |
| 4,178,714 | 12/1979 | Tsen et al. | 446/242 |
| 4,327,518 | 5/1982 | Knauff | 446/251 X |
| 4,363,181 | 12/1982 | Hyman et al. | 446/242 X |

FOREIGN PATENT DOCUMENTS

| | | | |
|---|---|---|---|
| 3123387 | 1/1983 | Fed. Rep. of Germany | 446/397 |

*Primary Examiner*—Robert A. Hafer
*Assistant Examiner*—D. Neal Muir
*Attorney, Agent, or Firm*—David Pressman

[57] ABSTRACT

A tune playing rotary toy comprises a centrifugally-actuated tune player comprising a casing (10) having a centrifugally-operable switch (30), an music synthesizer (32), and an energy cell (28). Upon rotation of the toy, it will experience centrifugal force, which will close the switch, which will in turn apply electrical energy from the cell to the circuit so that the stored tune will be emitted during rotation. The tune player may be mounted within or upon a toy gyroscopic top, e.g., of the stringless type (FIG. 1), or it may be self-contained with a spinner point and a manual spinning portion (FIG. 2B). The self-contained version may also be covered with sponge rubber (58) and attached to a twirling string (72) for swinging in a wide arc, preferably by means of a handle (78) on the end of the string opposite the tune player. The centrifugally-operable switch comprises a movable contact comprising a weight suspended at the end of a cantilever rod (42) and an L-, U-, or O-shaped fixed contact (38, 48, 50) for sensing motion of the movable contact in any of a variety of directions.

7 Claims, 11 Drawing Figures

TOY FOR ELECTRONICALLY PLAYING RHYTHMICAL MELODY UPON ROTATION OR REVOLUTION THEREOF

BACKGROUND

Field Of The Invention

This invention relates to toys, particularly to a toy for automatically playing a tune or voiced message upon operation thereof.

Description Of The Prior Art

Heretofore children have played with tops and other spinning toys of a wide variety of shapes, types, and modes of operation. For example, in my prior patent, U.S. Pat. No. 3,523,386, dated 1970 Aug. 11, a spinnable, stringless, gyroscopic top is shown which can be set into motion by rapidly rolling a roller protruding therefrom along a fixed surface in one direction several times to set a gyroscopic rotor therein into motion, whereupon the top will stand and spin on its tip for a period of time due to inertia of the rotor. Such a top, which has been widely sold under the trademark WIZ-Z-ZER, has great fascination and has provided much enjoyment for adults as well as children, but it would be desirable if this toy could be arranged to provide even more fascination and enjoyment.

Similarly, manually spinnable tops or jacks, string-operated gyroscopes, and various types of string-held twirling toys have been provided for the amusement of children. However these devices provided limited enjoyment, are generally of interest only to children, and usually failed to amuse their users for longer than a very brief period of time.

OBJECTS AND ADVANTAGES

Accordingly several objects and advantages of the invention are to provide a improved gyroscopic toy, to provide such a toy which provides more amusement, enjoyment, and pleasure to children, to provide such a toy which also will provide amusement to adults, to provide an addition for spinnable, rotatable, or twirlable toys which enhances the value, amusement, and operation of such toys, and to provide a version of the aforementioned WIZ-Z-ZER top which provides enhanced fascination and amusement. Further objects and advantages will become apparent from a consideration of the drawings and ensuing description.

DRAWINGS

FIGS. 2A and 2B are prespective views of a prior-art stringless gyroscopic top and an attachable or independently-usable tune generator according to the invention.

FIG. 3A is a cross-sectional view of a twirlable tune-playing toy according to the invention; FIG. 3B is a plan view of a anchor disc used in said toy; and FIG. 3C is a cross-sectional view of part of a foam ball used in said toy.

Figures 1, 4, 6:
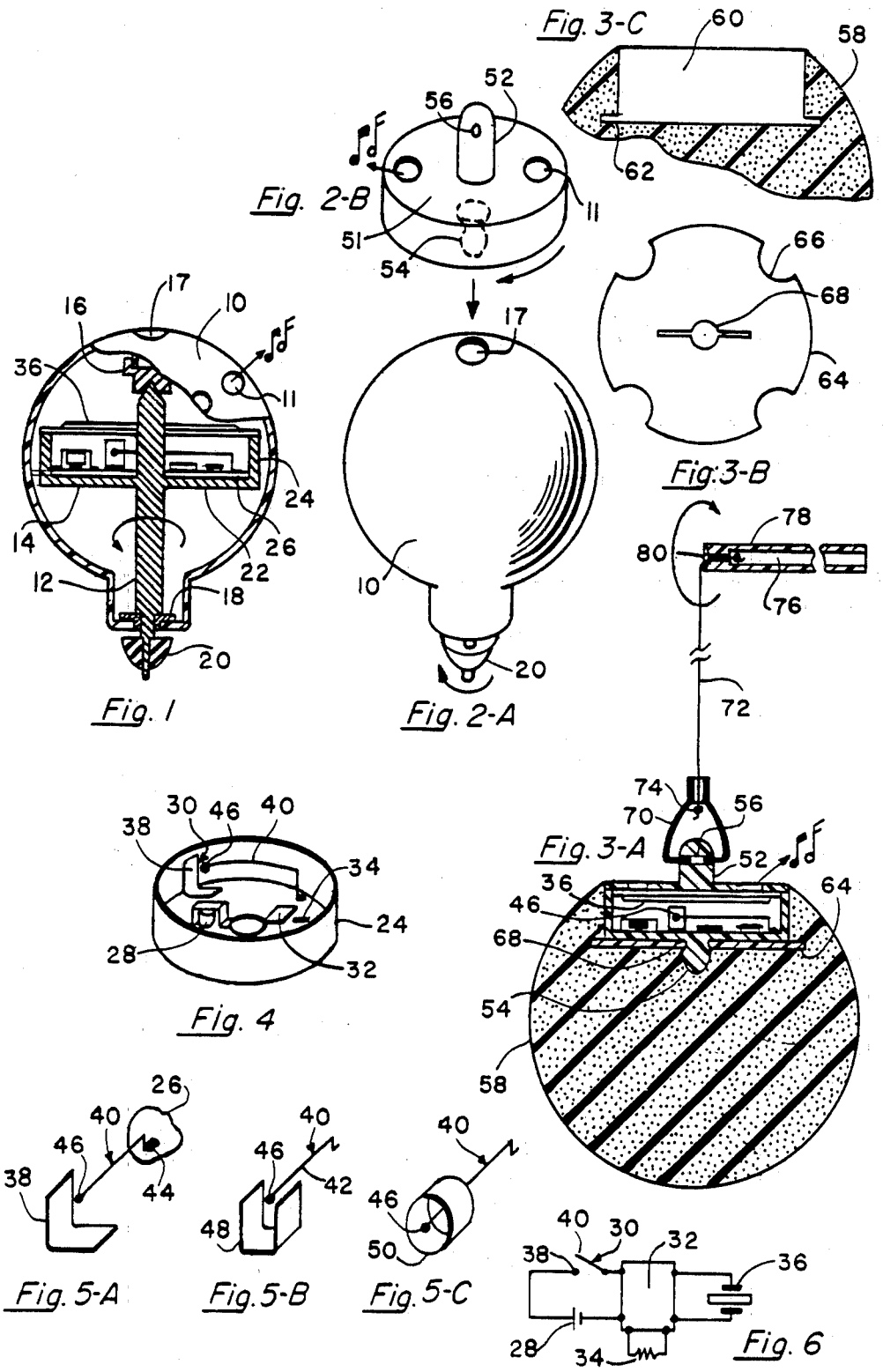
FIG. 1 is a partial cross-sectional view of a stringless gyroscopic top according to the invention.
FIG. 4 is a perspective view of the tune-playing device of the invention with its top removed.

FIGS. 5A, 5B, and 5C are perspective views of centrifugal switches according to the invention with L-shaped, U-shaped, and O-shaped fixed contacts.

FIG. 6 is a schematic diagram of an electronic circuit used in the invention.

| Reference Numerals | |
|---|---|
| 10 casing | 11 sound hole |
| 12 shaft | 14 rotor |
| 16 upper bearing | 17 socket |
| 18 lower bearing | 20 friction roller |
| 22 circular disc | 24 vertical flange |
| 26 printed circuit board | 28 energy cell |
| 30 centrifugal switch | 32 music synthesizer |
| 34 resistor | 36 piezoelectric transducer |
| 38 fixed contact | 40 movable contact |
| 42 arm of 40 | 44 solder |
| 46 contact ball of 40 | 48 U-shaped fixed contact |
| 50 O-shaped fixed contact | 51 lid of top |
| 52 upper shaft | 54 lower shaft |
| 56 hole in 52 | 58 foam ball |
| 60 recess in 58 | 62 circumferential slot |
| 64 holding disc | 66 notch in 64 |
| 68 hole in 64 | 70 yoke |
| 72 string | 74 knot |
| 76 through hole in 78 | 78 handle |
| 80 concave recess in 78 | |

SUMMARY

In accordance with the invention, rotatable and twirlable tops and toys are provided with an electronic music synthesizer and a centrifugal switch which causes the music synthesizer to be energized so as to emit a melody when the toy is spun or twirled, thereby to provide a very pleasing, novel, and unique effect.

FIG. 1—STRINGLESS GYROSCOPIC TUNE-PLAYING TOP

Description

A preferred embodiment of the invention is shown in FIG. 1. Here a gyroscopic top, similar to that of my aforementioned patent, is provided with a centrifugally-actuated music synthesizer in accordance with the invention.

The top of FIG. 1 consists of an outer casing 10 (shown cutaway in FIG. 1 and in full view in FIG. 2A). Casing 10 contains a spinnable gyroscopic rotatable assembly which consists of a shaft 12 and a joined, integral rotor 14. Casing 10 contains several spaced sound holes, one of which is shown at 11, for allowing sound generated from within the casing, to leave the casing. Shaft 12 is pivoted at the top and bottom of casing 10 by upper and lower bearings 16 and 18, which are generally similar to those of my above patent. Shaft 12 extends out through bottom bearing 18 and the bottom of casing 10 and has a friction roller 20 mounted at its lower end. Upper bearing 16 provides a pivot for shaft 12 at its bottom and has a cylindrical socket 17 at its top which is open at the top of the casing.

Rotor 14 consists of a circular metal disc 22 which has a circular integral flange 24 extending up from its outer edge. Mounted on disc portion 22, around or to one side of shaft 12, is a printed circuit board (PCB) 26 which is "stuffed" with sound-generating electronic components.

FIGS. 4, 5, and 6—ELECTRONIC CIRCUITRY

The components on board 26 of FIG. 1 are shown physically in more detail in FIGS. 4 and 5 and schematically in more detail in FIG. 6.

FIG. 4 shows a perspective view of rotor 14 with PCB 26 and its electronic components, but without shaft 12. In practice, rotor 14 and shaft 12 are cast integrally. (A similar rotor, PCB, and components is employed in the embodiments of FIGS. 2B and 3A.) These components, which are not numbered in FIG. 1 to preserve clarity, are shown schematically with their interconnections in FIG. 6. The PCB's traces, which interconnect the components thereon in conventional fashion, are also omitted for clarity.

The components on the PCB comprise an energy cell 28 which is connected in series with a centrifugally-operated switch 30 and two input terminals of a sound synthesizer 32. Two output terminals of synthesizer 32 are connected to drive a piezoelectric audio transducer 36. Two further, control terminals of synthesizer 32 are connected to a resistor 34 which controls the operating frequency and hence tempo of the output of synthesizer 32.

Energy cell 28 is preferably of the 1.3 to 1.5 volt mercury or silver type used in electronic watches and hearing aids. It is attached to the PCB both physically and electronically by means of an underlying trace (not shown) and a conventional clamp arrangement which soldered to other traces on the PCB (not shown). Switch 30 consists of a fixed contact 38 and a movable contact 40. Fixed contact 38, shown in more detail in FIG. 5A, consists of two flat, rectangular conductive plates which are joined together at a bend to provide an L-shaped contact; the horizontal plate being soldered to a trace (not shown) on PCB 26. Movable contact 40 consists of a wire 42, one end of which has a short horizontal section (FIG. 4) which is soldered to a trace on PCB 26 as shown at 44 in FIG. 5A. Wire 42 then has a short vertical portion extending up from PCB 26, and finally a long horizontal section, the end of which terminates in a ball 46 which provides a weighted contact. Ball contact 46 is positioned within the confines of L-shaped fixed contact 38, i.e., it faces both the horizontal and vertical members of the "L".

Sound synthesizer 32 is arranged to generate, at its output terminals, an electronic signal representative of a predetermined melody whenever its input terminals are energized from cell 28. Such synthesizers are now widely available and may be ordered for generating any melody (or any voiced message) desired. One suitable supplier is OKI Electric Industry Co., Santa Clara, Calif. Synthesizer 32 consists of an oscillator arranged to provide a continuous super-audible signal to a bank of frequency dividers. The bank of dividers is arranged to divide the signal from the oscillator down to the desired plurality of music-frequency signals (i.e., the notes of the melody to be played) and supply these to a plurality of transmission gates which can gate any one of the music signals to an amplifier. The gates are controlled by a ROM (read-only memory), which has a plurality of storage cells. The storage cells are sequentially addressed by a program counter (also driven by the oscillator) thereby to provide data outputs from information stored in the cells so as to render selected gates transmissive in the proper order to provide the predetermined melody at the synthesizer's output terminals.

Piezoelectric transducer 36 consists of a piezoelectric crystal sandwiched between two electrodes. When energized with a signal of any audio frequency, the crystal will vibrate at said frequency, thereby providing an audible tune output. The transducer comprises a relatively-large, platelike structure and it is adhesively mounted across the top of flange 24. It is provided with a hole (not shown) in its center to accommodate shaft 12. Its leads have been omitted for clarity.

The switch of FIG. 5A will be closed (i.e., conductive or transmissive) whenever movable contact 40 moves to the left or down. This occurs because ball contact 46 will thereupon meet either of the plates of fixed contact 38. In FIG. 5B, a U-shaped fixed contact 48 is shown; this will be conductive whenever ball 46 moves to the left, right, or down. The switch of FIG. 5*b* should be used when the switch is placed near the center of the rotor, at a position where centrifugal force may move the ball either to the left or right. In FIG. 5C, an O-shaped fixed contact 50 is provided; this contact serves the same function as the U-shaped contact of FIG. 5B, but also provides protection to the movable contact by preventing the ball from moving out of the confines of the fixed contact in case of shocks or jolts.

FIG. 1—OPERATION

To operate the top of FIG. 1, casing 10 is held in the hand and friction roller 20 is briskly and repetitively moved in one direction on a hard, fixed surface in order to bring shaft 12 and rotor 14 up to a relatively high rotational speed, as indicated. Because of its relatively high inertial moment, rotor 14 will continue to spin for an appreciable time once it is brought up to speed, thereby providing a gyroscopic force which will enable the top to remain in a state of dynamic equilibrium when placed on its bottom tip, so long as rotor 14 continues to spin at a sufficient speed, as explained in my above patent. (When the top is placed on its lower tip and released, casing 10 will also begin to rotate with rotor-shaft assembly 14–16 until all parts of the top are at the same rotational speed—this due to the fact that friction is greater at upper and lower bearings 16 and 18 than at the bottom tip. However the rotation of the casing will not affect the gyroscopic action of the top or its musical action.)

In accordance with the invention, when rotor 14 rotates, centrifugal force will be applied to ball contact 46. This will cause the ball to move out and contact the vertical plate of fixed contact 38, closing switch 30. Ball contact 46 can so move because arm 42 of movable contact 40 is positioned near the outer edge of the rotor and is substantially perpendicular to an imaginary radius of rotor 14. This allows arm 42 to bend outward in an arc about its point of attachment 44 so that ball 46 can contact the vertical plate of fixed contact 38, as stated.

When switch 30 closes, cell 28 will energize synthesizer 32, causing it to supply a signal representative of the predetermined tune to transducer 36. Transducer 36 will emit an audible sound representative of the tune, which will resonate on PCB 26 and pass out of the casing via its sound holes, such as 11, as indicated. In one embodiment, the melody of Beethoven's "Fur Elise" was played; this melody provided a very compatible rhythmical accompaniment to the rotation of the top.

Due to centrifugal force, switch 30 will remain closed, and hence the melody will be played, as long as the rotor 14 rotates at a speed sufficient to keep the top in dynamic equilibrium. When the speed of the rotor diminishes due to energy loss from air and point friction, the top will fall due to loss of gyroscopic effect and the melody will cease because ball contact 46 will experience insufficient centrifugal force to keep it in contact with fixed contact 38. Thus the melody and the balance of the top will terminate substantialy together, a desirable effect. By thus stopping the melody automatically, the life of cell 28 will be preserved vis-a-vis the use of a manual shutoff means.

FIGS. 2A AND 2B—SEPARATE TUNE GENERATOR

In lieu of mounting the centrifugally-actuated tune generator within the top, it can alternatively be mounted outside the top in its own, independently-spinnable casing, as shown in FIGS. 2A and 2B.

FIG. 2A shows the top of FIG. 1, but without the tune generator therein. Thus the top of FIG. 2A is similar to that of my above-cited patent, except for recess socket 17 at its top. It is thus usable to provide a gyroscopic, dynamic-balancing action, without generating any tunes.

The top of FIG. 2B has components similar to those within rotor 14 of FIG. 1, including the electronic tune-generating components (not shown in FIG. 2B) and a cover or lid 51. In lieu of the shaft of FIG. 1, the top of FIG. 2B includes a upper, manually-operable (finger-spinnable) shaft 52 and a bottom pivot and male plug shaft 54. Preferably, for ease of construction, upper and bottom shafts 52 and 54 are separately attached to lid 51 and the bottom of the top, respectively, but they also can be integral and extend through the top (not shown). Upper shaft 52 is preferably knurled for ease of manual spinning and includes a string or holder hole 56, which will be explained in connection with FIG. 3A. Bottom shaft 54 is sized and has a constricted waist shape so as to mate with a snap fit into socket 17 of the top of FIGS. 1 and 2A. Alternatively shaft 54 can mate with a friction fit or shaft 54 and recess 17 can be mutually threaded. Transducer 36 (not shown) is mounted, e.g., by epoxy, to the underside of lid 51, as shown in FIG. 3A. In operation, the top of FIG. 2B can be spun independently by rapidly twisting and releasing its upper shaft 52, whereby the top will spin on the bottom point of its lower shaft 54 while simultaneously emitting the tune due to centrifugal operation of its internal switch 30, as described above.

Alternatively, the top of FIG. 2 can be plugged into socket 17 at the upper end of the top of FIG. 2A. Thereupon operation of the assembly using lower friction roller 20 in the manner as described in connection with FIG. 1 will cause the assembly to dynamically balance on its lower tip and simultaneously emit a tune from its upper portion (the top of FIG. 2), as indicated.

Thus the combined tops of FIGS. 2A and 2B can be used separately or together. This is advantageous since the assembly will provide amusement for two children. Also, only the top of FIG. 2B need be replaced or opened when the energy cell is depleted.

FIGS. 3A TO 3C—TWIRLABLE TOY

In addition to being operable upon rotation about their own axis, the tops of the invention can also be operated by twirling them in a large circle such that their axes lie on the radii of the circle. Thus by attaching a string to upper spinning shaft 52 of the top of FIG. 2B and twirling said top in a great circle, e.g,, to one's side or about one's head, it will emit its melody. In this mode of operation, ball contact 46 will be forced down by centrifugal force and contact the lower plate of L-shaped fixed contact 38.

As shown in FIG. 3A, the top of FIG. 2 is mounted within a cushioning and protecting sponge rubber or foam ball 58 about 8 cm in diameter, with all other parts being sized proportionally as indicated. Ball 58 has a circular recess 60 in its top, best seen in FIG. 3C. At the bottom of recess 60, a circular circumferential extension groove 62 is cut. A retention plate 64 with anti-rotation notches 66 is fitted into groove 62 where it will be securely held. Plate 64 has a central hole 68 with side extension slots for receiving and holding bottom shaft 54 of the top of FIG. 2B when it is placed into recess 60, as shown in FIG. 3A. The top is also held in ball 58 by friction fit with the side of recess 60.

A holding yoke 70 with two free-ended feet is fitted into hole 56 of upper shaft 52 of the top and a string 72 about 1 m long is placed through a through-hole in the upper end of yoke 70. String 62 has a knot 74 at its bottom, free end to retain it in yoke 70. While string 62 could be knotted directly through hole 56, the use of holding yoke 70 enables the string to be quickly released from the top so that one can readily spin the top, as indicated with respect to FIG. 2B. The upper end of string 72 is passed through axial hole 76 in a handle 78. One end of hole 76 has a narrowed portion for preventing the knot and string from slipping therethrough. The end of handle 78 from which string 72 emerges has a concave recess 80 which leads into the constricted portion of hole 76. The rim of concave recess 80 is smooth so that upon twirling the assembly, string 72 will move continusly and freely over such rim and will not have an intermittent or jerky motion which might interrupt the centrifugal force and thus the music emitted by the top.

In operation, handle 78 is manually held and twirled in a small circle about 14 cm in diameter. This will cause ball 58 and the top mounted therein to twirl at the end of string 72 in a large circle about 1 m in dimeter, with string 72 being pulled taut by centrifugal force. Centrifugal force will also force ball contact 46 of switch 30 down, where it will contact the horizontal plate of fixed L-shaped contact 38, thereby turning on the tune generator while the unit is twirled. Upon cessation of twirling, ball contact 46 will move up, under spring pressure from arm 42, causing the melody to stop. The use of sponge ball 58 is not necessary, but is provided as a safety measure to protect animals in the vicinity and to prevent shock injuries to the top in case it hits a hard object while being twirled.

When the user desires to play with the top alone, yoke 70 is removed from upper shaft 52 and the top is pulled free of the ball, whereupon it can be used as described in connection with FIG. 2B or associated with the top of FIG. 2A.

The U-shaped or O-shaped contacts of FIGS. 5B or 5C can be substituted for the L-shaped contact of FIG. 5*a* if the switch is mounted nearer the axis of the rotor or for more reliability against damage, respectively.

While the above description contains many specificities, these should not be construed as limitations on the scope of the invention, but merely as examples of the preferred embodiments thereof. Many variations are possible. For example, the tune generator within FIG. 3A need not be encased within a top. Also in lieu of an electronic tune generator, a windup, musical-box, mechanical-type tune generator can be employed, in which case a centrifugal-force-responsive mechanical release and catch may be employed to start and stop the action. In lieu of the switch mechanisms shown, a mercury switch may be employed. In lieu of a top with a bottom friction roller as shown in FIGS. 1 and 2A, tops with side rollers, as shown in my above patent, may be employed. Accordingly the scope of the invention should be determined by the following claims and their legal equivalents, and not by the examples given.

I claim:

1. A rotation-sensitive sound generating device, comprising, in combination:

(a) centrifugal actuation means for providing a predetermined actuation in response to centrifugal force applied thereto by turning thereof, said centrifugal actuation means comprising an electrical switch having a moveable contact member which is mounted to move in either of two predetermined directions and complete an electrical circuit by contacting another member in response to centrifugal force applied thereto from either (1) rotation of said enclosure about an axis through said enclosure, or (2) revolution of said enclosure about the circumference of a circle such that said axis of said enclosure is always oriented as a radius of said circle, respectively, (b) sound generation means for generating a predetermined sequence of a plurality of different sounds in response to an actuation thereof from said centrifugal actuation means, said sound generation means comprising an electrical energy cell, a sound transducer, and an electronic integrated circuit module which is arranged to produce an electrical signal representative of a predetermined melody having a predetermined rhythm upon energization thereof, said electrical switch being connected between said energy cell and said integrated circuit module, and said sound transducer being connected to receive said electrical signal and thereby audibly reproduce said melody in response to generation of said signal, (c) an enclosure, said enclosure holding said centrifugal actuation means and said sound generation means therewithin, and (d) turning means for causing said enclosure to rotate or revolve, so that upon rotation or revolution of said enclosure, said centrifugal force will be applied to said centrifugal actuation means, thereby to close said switch so as to provide said predetermined acutation to said sound generation means by connecting said energy cell thereof to said integrated circuit, such that said sound transducer will thereupon generate said predetermined melody with said predetermined rhythm, all in response to rotation of said enclosure, said turning means comprising a removable, flexible tether attached to said enclosure on said axis thereof, said tether having manual holding means thereon at a location remote from its point of attachment to said enclosure, whereby upon rotation or revolution of said enclosure, it will emit an audible rhythmical melody to accompany and enhance the sensory effect of the rotation or revolution of said enclosure.

2. The sound generating means of claim 1 wherein said enclosure is surrounded by energy absorbing padding means so that injury will be prevented if said enclosure strikes an animal when said tether is rotated.

3. The sound generating means of claim 1 wherein said manual holding means on said flexible tether comprises a handle at the end of said tether distal from its point of attachment to said enclosure.

4. The sound generating means of claim 3 wherein said handle comprises an elongated member having a hole therethrough oriented along the axis thereof, said flexible tether extending into said hole, said hole having a concave lead-in opening at the end of said handle, the rim of said concave lead-in being smooth so that revolution of said tether will be continuous and smooth upon twirling of said handle.

5. The sound generating means of claim 1 wherein said electrical switch of said centrifugal actuation means comprises a weight which is mounted so as to move in one direction upon rotation of said enclosure about said axis and move in a direction orthogonal to said one direction upon rotation of said enclosure about said circumference, and including contact means for closing an electrical circuit in response to movement of said weight in either direction.

6. The sound generating means of claim 6 wherein said contact means comprises a conductive member having two flat orthogonally-related portions having an "L" shape when viewed in a direction parallel to the planes of said two flat portions, and wherein said weight is mounted on a pivot arm extending generally parallel to said two flat portions, said weight being positioned within the confines of said "L" so as to face both of said flat portions.

7. The sound generating means of claim 6 wherein said contact means comprises a conductive member having three flat orthogonally-related portions having an "U" shape when viewed in a direction parallel to the planes of said two flat portions, and wherein said weight is mounted on a pivot arm extending generally parallel to said three flat portions, said weight being positioned within the confines of said "U" so as to face all three of said flat portions.

* * * * *